US010604939B2

(12) United States Patent
Hendricks, Jr. et al.

(10) Patent No.: US 10,604,939 B2
(45) Date of Patent: Mar. 31, 2020

(54) TELESCOPING RIDGE VENT

(71) Applicant: Owens Corning Intellectual Capital, LLC, Toledo, OH (US)

(72) Inventors: Robert K. Hendricks, Jr., Niles, OH (US); Chris M. Robinson, Perrysburg, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 16/270,700

(22) Filed: Feb. 8, 2019

(65) Prior Publication Data

US 2019/0249440 A1 Aug. 15, 2019

Related U.S. Application Data

(60) Provisional application No. 62/630,916, filed on Feb. 15, 2018.

(51) Int. Cl.
*E04D 13/17* (2006.01)

(52) U.S. Cl.
CPC ..... *E04D 13/174* (2013.01)

(58) Field of Classification Search
CPC ..... E04D 13/174
See application file for complete search history.

(56) References Cited

U.S. PATENT DOCUMENTS 2,447,472 A 8/1948 Donley
2,777,381 A 1/1957 Noyes et al.
4,325,290 A 4/1982 Wolfed
4,554,862 A 11/1985 Wolfed
4,803,813 A 2/1989 Fiterman
4,807,409 A 2/1989 Sells
4,843,953 A 7/1989 Sells
4,907,499 A * 3/1990 James ..... E04D 13/174 454/365
4,924,761 A * 5/1990 MacLeod ..... E04D 13/143 454/365
5,054,254 A 10/1991 Sells
5,060,431 A * 10/1991 MacLeod ..... E04D 13/174 454/250
5,094,041 A 3/1992 Kasner et al.
5,122,095 A 6/1992 Wolfed
5,149,301 A * 9/1992 Gates ..... E04D 13/174 454/365
5,167,579 A 12/1992 Rotter
(Continued)

FOREIGN PATENT DOCUMENTS

CA 2269571 A1 * 10/1999 ..... E04D 13/174
CA 2499557 A1 * 9/2006 ..... E04D 13/174

OTHER PUBLICATIONS

US 7,367,879 B2, 05/2008, Villela (withdrawn)

*Primary Examiner* — Robert Canfield
(74) *Attorney, Agent, or Firm* — Calfee, Halter & Griswold LLP

(57) ABSTRACT

Ridge vents are configured to cover an open ridge of a roof and allow a flow of air to exit from the open ridge through the ridge vents. The ridge vents include a projection and a projection receiving area. When a first ridge vent is secured over a ridge opening, the projection of a second ridge vent is at least partially receivable in the projection receiving area of the first ridge vent.

15 Claims, 10 Drawing Sheets

(56) References Cited

U.S. PATENT DOCUMENTS 5,174,076 A * 12/1992 Schiedegger ..... E04D 13/174 454/3
5,238,450 A 8/1993 Rotter
5,288,269 A 2/1994 Hansen
5,304,095 A 4/1994 Morris
5,326,318 A 7/1994 Rotter
5,328,406 A 7/1994 Morris et al.
5,331,783 A 7/1994 Kasner et al.
5,352,154 A 10/1994 Roller et al.
5,425,672 A 6/1995 Rotter
5,427,571 A 6/1995 Sells
5,439,417 A 8/1995 Sells
5,458,538 A * 10/1995 MacLeod ..... E04D 13/174 454/365
5,542,882 A 8/1996 Sells
5,560,157 A 10/1996 Rotter
5,561,953 A 10/1996 Rotter
5,596,847 A 1/1997 Stephenson
5,603,657 A 2/1997 Sells
5,630,752 A 5/1997 Gubash
5,651,734 A 7/1997 Morris
5,673,521 A 10/1997 Coulton et al.
5,676,597 A 10/1997 Bettoli et al.
5,704,834 A 1/1998 Sells
5,772,502 A 6/1998 Smith
5,830,059 A 11/1998 Sells
5,832,677 A 11/1998 Kurttila
5,921,863 A 7/1999 Sells
5,934,995 A 8/1999 Morris et al.
5,946,868 A 9/1999 Morris
5,947,817 A 9/1999 Morris et al.
5,996,289 A 12/1999 Allaster
6,015,343 A 1/2000 Castillo et al.
6,039,646 A 3/2000 Sells
6,128,869 A 10/2000 Brotherton et al.
6,145,255 A 11/2000 Allaster
6,149,517 A 11/2000 Hansen
6,212,833 B1 4/2001 Henderson
6,213,868 B1 4/2001 Sells
6,227,963 B1 5/2001 Headrick
6,233,887 B1 5/2001 Smith
6,260,315 B1 7/2001 Smith
6,267,668 B1 7/2001 Morris
6,277,024 B1 * 8/2001 Coulton ..... F24F 7/02 454/365
RE37,388 E 9/2001 Kasner et al.
6,286,273 B1 9/2001 Villela et al.
6,299,528 B1 10/2001 Hansen
6,302,785 B1 10/2001 McKinney et al.
6,357,193 B1 3/2002 Morris
6,371,847 B2 4/2002 Headrick
6,418,692 B1 7/2002 Freshwater et al.
6,447,392 B1 9/2002 Henderson
6,450,882 B1 9/2002 Morris et al.
6,458,029 B2 10/2002 Morris
D465,839 S 11/2002 Sells
6,482,084 B2 11/2002 Hansen
6,487,826 B1 12/2002 McCorsley et al.
6,530,189 B2 3/2003 Freshwater et al.
6,537,147 B2 3/2003 Smith
6,558,251 B2 5/2003 Sells
6,565,431 B1 5/2003 Villela
6,578,325 B2 6/2003 Henderson
6,589,113 B2 7/2003 Sells
6,595,849 B2 7/2003 Miller
6,598,356 B1 7/2003 Sells
6,599,184 B2 7/2003 Morris
6,623,354 B2 9/2003 Morris et al.
6,684,581 B2 * 2/2004 Robinson ..... E04D 13/176 454/365
6,793,574 B1 9/2004 Robinson
6,881,144 B2 4/2005 Hansen et al.
6,913,530 B2 7/2005 Morris et al.
D511,847 S 11/2005 Ciepliski
D511,848 S 11/2005 Ciepliski
6,991,535 B2 1/2006 Ciepliski et al.
7,024,828 B2 4/2006 Headrick
7,044,852 B2 5/2006 Horton
7,143,557 B1 12/2006 Ayers, Jr.
7,165,363 B2 1/2007 Headrick, II et al.
7,302,776 B2 12/2007 Duncan et al.
7,384,331 B2 6/2008 Coulton
D574,947 S 8/2008 Grisham et al.
7,485,034 B2 2/2009 Sells
7,520,098 B1 4/2009 Martinique et al.
7,537,518 B2 5/2009 Villela et al.
7,540,803 B2 6/2009 Sells
7,562,498 B2 7/2009 Galeazzo et al.
7,591,109 B2 9/2009 Rotter
7,594,362 B2 9/2009 Sigmund et al.
D602,579 S 10/2009 Stone
7,604,536 B2 10/2009 Coulton et al.
7,644,545 B2 1/2010 Mankell et al.
7,662,037 B2 * 2/2010 Polston ..... E04D 13/174 454/365
7,716,894 B2 5/2010 Jolitz
D618,331 S 6/2010 Stone
7,765,750 B2 8/2010 Duncan
7,766,735 B2 8/2010 Ciepliski et al.
7,823,343 B1 11/2010 Inzeo
7,856,764 B2 12/2010 Kortuem et al.
8,028,475 B2 10/2011 Sigmund et al.
8,061,102 B2 11/2011 Turek et al.
D654,161 S 2/2012 Holland et al.
8,136,322 B2 3/2012 Shadwell et al.
8,205,398 B2 6/2012 Chich et al.
8,292,707 B2 10/2012 Grisham et al.
8,528,269 B2 9/2013 Chich et al.
8,528,270 B2 9/2013 Chich et al.
8,790,167 B2 7/2014 Holland et al.
9,022,845 B2 5/2015 Henderson
9,353,962 B2 5/2016 Lowe et al.
9,777,476 B2 * 10/2017 Grubka ..... E04D 13/174
10,151,500 B2 12/2018 Grubka et al.
10,233,650 B2 * 3/2019 Fiser ..... E04D 13/174
2004/0029523 A1 2/2004 Morris et al.
2004/0198216 A1 10/2004 Morris et al.
2005/0136830 A1 6/2005 Morris et al.
2006/0116069 A1 6/2006 Urbanski et al.
2006/0240762 A1 10/2006 Railkar et al.
2007/0026789 A1 2/2007 Villela
2007/0072540 A1 * 3/2007 Ciepliski ..... E04D 13/174 454/365
2007/0117505 A1 5/2007 Wey et al.
2007/0234650 A1 10/2007 Coulton et al.
2008/0125028 A1 5/2008 Morris et al.
2008/0182507 A1 7/2008 Morris et al.
2008/0287054 A1 * 11/2008 Carlson ..... E04D 13/174 454/365
2008/0299892 A1 12/2008 Robinson
2009/0130969 A1 5/2009 Grisham et al.
2009/0166928 A1 7/2009 Carlson et al.
2009/0233541 A1 9/2009 Holland et al.
2010/0043311 A1 2/2010 Chich et al.
2010/0043312 A1 2/2010 Chich et al.
2010/0112932 A1 * 5/2010 Grubka ..... E04D 13/174 454/365
2010/0144266 A1 6/2010 Lowe et al.
2011/0030287 A1 2/2011 Moore
2011/0111690 A1 5/2011 Henderson
2011/0124280 A1 5/2011 Railkar et al.
2011/0154743 A1 6/2011 Railkar
2011/0195655 A1 8/2011 Holland et al.
2011/0201266 A1 8/2011 Henderson
2011/0265407 A1 11/2011 Bryson
2011/0277394 A1 11/2011 Chich et al.
2018/0016794 A1 * 1/2018 Hendricks, Jr. ..... E04D 13/176

* cited by examiner

TELESCOPING RIDGE VENT

RELATED APPLICATIONS

This application claims priority to and any benefit of U.S. Provisional Patent Application No. 62/630,916, filed Feb. 15, 2018, the content of which is incorporated herein by reference in its entirety.

BACKGROUND

Buildings, such as residential buildings, may be covered by a sloped roof. The interior portion can form a space called an attic. If unventilated, condensation can form on the interior surfaces within the attic. The condensation can cause damage to various building components within the attic, including, but not limited to the insulation, as well as potentially causing damage to the building structure of the attic. Accordingly, it is known to ventilate attics thereby helping to prevent the formation of condensation. One example of a method of ventilating an attic includes the positioning of ridge vents at the roof ridge, which is the intersection of the uppermost sloping roof planes. The ridge vents can cooperate with eave vents, positioned in the eaves, to allow a flow of air to enter the eave vents, travel through a space between adjoining roof rafters to the attic, travel through the attic and exit through the ridge vents.

Ridge vents can be positioned over an elongated opening formed between the uppermost sloping roof planes. The opening can allow hot-air within the attic to escape the attic. Ridge vents can be provided in discrete sections that can be placed end-to-end over the opening. Discrete sections of the ridge vents can be flexed to conform to the shape of the sloping roof planes and attached to the roof planes via roof nails. Further, as ridge vents are exposed on the exterior of a house or building, they are subjected to the varying outside temperatures and may expand or contract depending on changes in temperature.

SUMMARY

In accordance with embodiments of this invention, ridge vents are configured to cover an open ridge of a roof and allow a flow of air to exit from the open ridge through the ridge vents. The ridge vents include a projection and a projection receiving area. When a first ridge vent is secured over a ridge opening, the projection of a second ridge vent is at least partially receivable in the projection receiving area of the first ridge vent.

In one exemplary embodiment, the ridge vents include a front face, a rear face, a top surface, left and right edges, a center portion, left and right portions connected to the center portion, first and second front face projections extending outwardly from the front edge and inset from the left and right edges, and a rear projection disposed on the rear face and extending outwardly therefrom. The top surface and first and second front face projections define a rear projection receiving area. When a first ridge vent is secured over a ridge opening, the rear projection of a second ridge vent is at least partially receivable in the rear projection receiving area of the first ridge vent.

In accordance with other embodiments, there are also provided ridge vent systems configured to cover an open ridge of a roof and allow a flow of air to exit from the open ridge through the ridge vent. The ridge vent systems include a plurality of ridge vents having a front edge, a rear edge, a top surface, a center portion, and left and right edges connected to the center portion, and a plurality of temperature guide lines disposed on the top surface which indicate a distance the rear edge should be inserted into the front edge of another ridge vent. The front edge of one ridge vent is connectable to the rear edge of a subsequently installed ridge vent. Adjacent ridge vents are connected at a position aligning the front edge of the previously installed ridge vent with the temperature guide line corresponding to the ambient temperature at installation of the subsequently installed ridge vent.

In accordance with other embodiments, there are also provided methods for installing ridge vents over an open ridge of a roof and allowing a flow of air to exit from the open ridge through the ridge vents. The methods include the steps of providing a ridge vent, the ridge vent having a front face, a rear face, a top surface, left and right edges, a center portion, left and right portions connected to the center portion, first and second front face projections extending outwardly from the front edge and inset from the left and right edges, and a rear projection disposed on the rear face and extending outwardly therefrom, wherein the top surface and first and second front face projections define a rear projection receiving area, positioning a first ridge vent over the open ridge of the roof, fastening the first ridge vent to the roof decks, positioning the front face projections of subsequent ridge vents in the same direction as the first ridge vent, inserting the rear projection of subsequently positioned ridge vents in the rear projection receiving area of the previously installed ridge vents, and covering the installed ridge vents with ridge shingles Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with embodiments of the present invention, a roof ridge vent (hereafter "vent") is provided. It will be understood the term "ridge" refers to the intersection of the uppermost sloping roof planes. The term "roof deck" is defined to mean the plane defined by a roof surface. The term "sheathing," as used herein, is defined to mean exterior grade boards used as a roof deck material. The term "roof deck," as used herein, is defined to mean the surface installed over the supporting framing members to which the roofing is applied. The term "louvers," as used herein, is defined to mean a quantity of openings positioned in a ridge vent and/or an intake vent and used for ventilation purposes.

Figure 1:
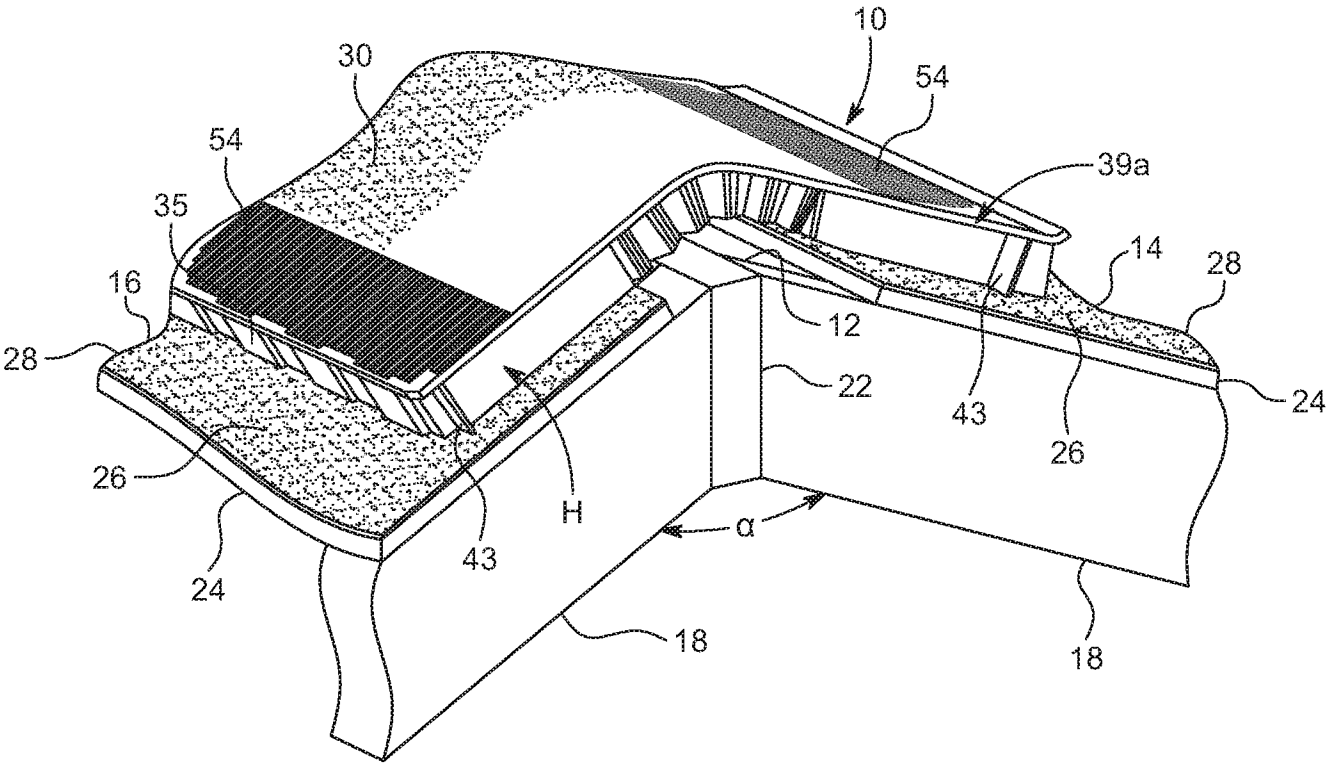
FIG. 1 is a partial perspective view of a ridge vent shown installed on a portion of a roof in accordance with embodiments of this invention.
Figure 2:
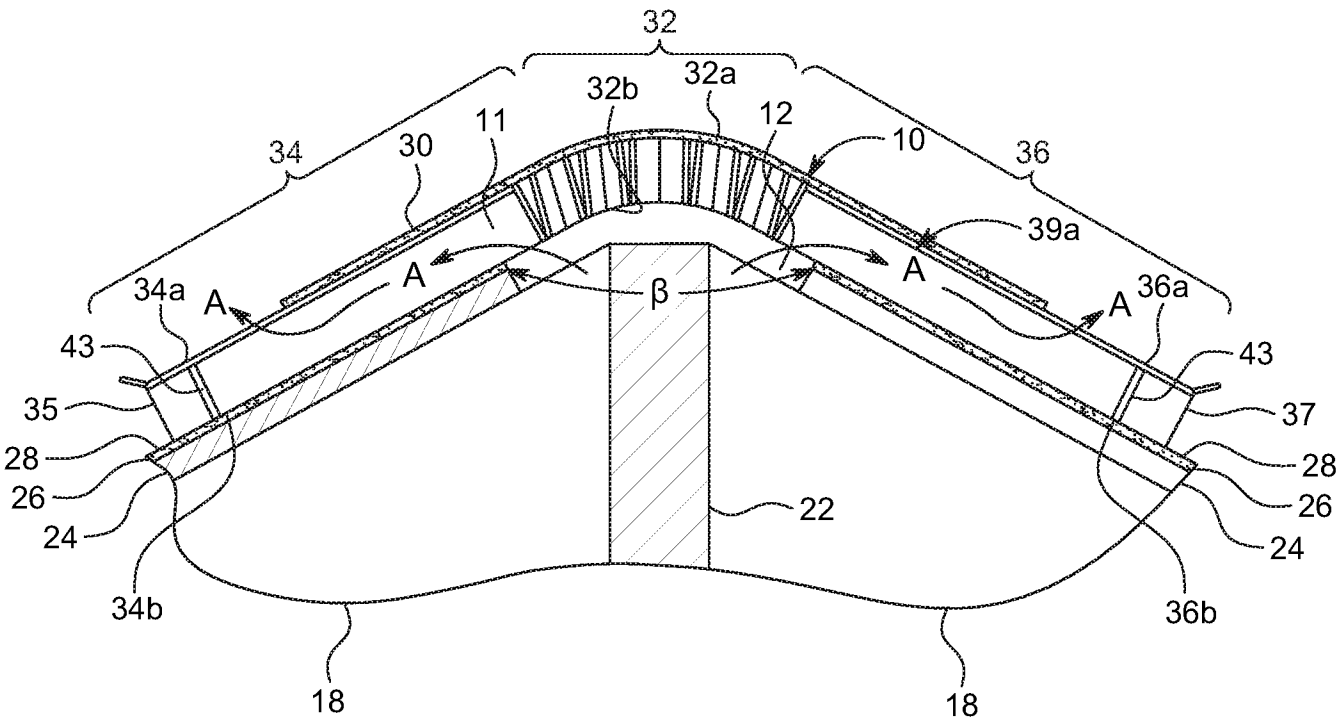
FIG. 2 is a front elevational view of the ridge vent of FIG. 1 shown installed on a portion of a roof.

Referring now to FIGS. 1 and 2, an exemplary ridge vent 10 is shown. Generally, the ridge vent 10 is configured to span a ridge opening 12 formed between opposing first and second roof planes, 14 and 16, and allow a flow of air to travel through an attic and exit through the ridge vent 10.

Each of the first and second roof planes, 14 and 16, is formed by a series of generally parallel, spaced apart rafters 18 (for purposes of clarity, only one rafter 18 is shown for each of the roof planes, 14 and 16). In the illustrated embodiment, the rafters 18 are connected at one end to a ridge board 22 and at the other end to a wall (not shown). In other embodiments, the ends of the rafters 18 can be connected to other desired components or structures. In the illustrated embodiment, the rafters 18 and the ridge board 22 are made from framing lumber, having sizes including, but not limited to 2 inches thick by 10 inches wide. Alternatively, the rafters 18 and the ridge board 22 can be made from other desired materials and have other desired sizes. The roof can have a wide variety of different forms. For example, the roof may be a "truss-type" roof where the support structure of the roof comprises spaced apart trusses, rather than rafters and ridge boards.

The first and second roof planes, 14 and 16, form a slope angle $\alpha$. In the illustrated embodiment, the slope angle $\alpha$ is approximately 120°. Alternatively, the slop angle $\alpha$ can be more or less than approximately 120°.

As shown in FIGS. 1 and 2, the rafters 18 (or trusses) are covered by a sheathing 24. The sheathing 24 is configured to form an upper surface 28 of the roof planes, 14 and 16. In the illustrated embodiment, the sheathing 24 is made of a wood-based material, including, but not limited to oriented strand board or plywood. In other embodiments, the sheathing 24 can be other desired materials.

The upper surfaces 28 of the roof planes, 14 and 16, support a plurality of shingles 26. The shingles 26 are attached to the upper surface 28 of the sheathing 24 by using any desired fasteners, including, but not limited to roofing nails (not shown). It should be understood that the shingles 26 can be of any desired roofing material.

While the ridge opening 12 shown in FIGS. 1 and 2 is formed by the structure of the rafters 18, ridge board 22 and roof planes, 14 and 16, it should be understood the ridge opening 12 can be formed by other structures or combination of structures.

As shown in FIG. 2, the ridge vent 10 includes a ridge vent body 11 that includes a center portion 32, a left portion 34 and a right portion 36. The center portion 32, left portion 34 and right portion 36 each have a top surface, 32*a*, 34*a*, and 36*a*, respectively, and a bottom surface, 32*b*, 34*b*, and 36*b*, respectively. The left portion has a left edge 35 and the right portion 36 has a right edge 37. The ridge vent 10 also includes a front edge 39*a* toward the front of the ridge vent 10 and a rear edge 39*b* (not pictured) toward the rear of the ridge vent 10. While the front edge 39*a* is described as being toward the front of the ridge vent 10 and the rear edge 39*b* is described as being toward the rear of the ridge vent 10, it is appreciated that front and rear are mere terms for lateral edges of the ridge vent 10 and may be reversed.

The front and rear edges, 39*a* and 39*b*, are disposed along the lateral edges of the center, left, and right portions, 32, 34, and 36, on the underside of the top surfaces, 32*a*, 34*a*, and 36*a*. As will be described below in greater detail, portions of the front edge 39*a* define a rear projection receiving area, the rear edge 39*b* includes a rear projection, and the rear projection and rear projection receiving area are telescopingly couplable. Traditional interlocking features of ridge vents do not accommodate substantial temperature changes. Temperature changes can cause the ridge vents to expand or contract and can thereby create gaps between the vents, cause strain on the interlocking and/or cause a ridge vent section to buckle or slide above or below an adjacent vent section.

Referring again to FIG. 2, the center portion 32 of the ridge vent 10 is configured to flex, thereby allowing the left and right portions, 34 and 36, to form a ridge vent angle $\beta$. The ridge vent angle $\beta$ is configured to allow the bottom surfaces, 34*b* and 36*b*, of the left and right portions, 34 and 36, to seat against the first and second roof planes, 14 and 16. In the illustrated embodiment, the ridge vent angle $\beta$ is the same angle as the slope angle $\alpha$ formed by the opposing rafters 18. In other embodiments, the ridge vent angle $\beta$ can be other angles suitable to allow the bottom surfaces, 34*b* and 36*b*, of the left and right portions, 34 and 36, to seat against the first and second roof planes, 14 and 16. As will be explained later in more detail, the left and right portions, 34 and 36, of the ridge vent 10 are fastened to the roof planes, 14 and 16, and portions of the ridge vent 10 are covered by a row of vent shingles 30.

As shown in FIG. 2, the ridge vent 10 spans the ridge opening 12 formed between the first and second roof planes, 14 and 16, and allows a flow of exhaust air to travel through an attic and exit through the ridge vent 10. The flow of the exhaust air is shown by the arrows A.

Ridge vents which flex and span a ridge opening in a roof are known in the art. One such ridge vent is described in U.S. application Ser. No. 12/393,261 to Grubka et al., filed Feb. 10, 2009, and published May 6, 2010 as U.S. Publication No. 2010/0112932A1, the entire disclosure of which is incorporated herein by reference.

In an exemplary embodiment, the ridge vent 10 has a plurality of vents or louvers 54 disposed on the lateral portions of the top surfaces, 34*a* and 36*a*, of the left and right portions, 34 and 36. The louvers 54 extend through the top surfaces, 34*a*, and 36*a*, of the left and right portions, 34 and 36, and, in operation, air flows through the ridge vent 10 via the louvers 54. When the ridge vent 10 is attached to a roof covering the ridge opening 12, the louvers 54 define an airflow path from the attic, through the ridge vent 10, and to the outside environment. In the illustrated embodiment, the louvers 54 are arranged in a column and row configuration having a quantity of two columns and rows extending along the length of the ridge vent 10. The louvers 54 are also square or rectangular and evenly spaced on the lateral edges of the top surfaces, 34*a* and 36*a*, of the left and right portion, 34 and 36. In other embodiments, the louvers 54 can be arranged in other desired configurations, can be positioned in other desired locations sufficient to allow the flow of air to exit the ridge vent 10 through the louvers 54, and/or can be different sizes and shapes.

Figure 3:
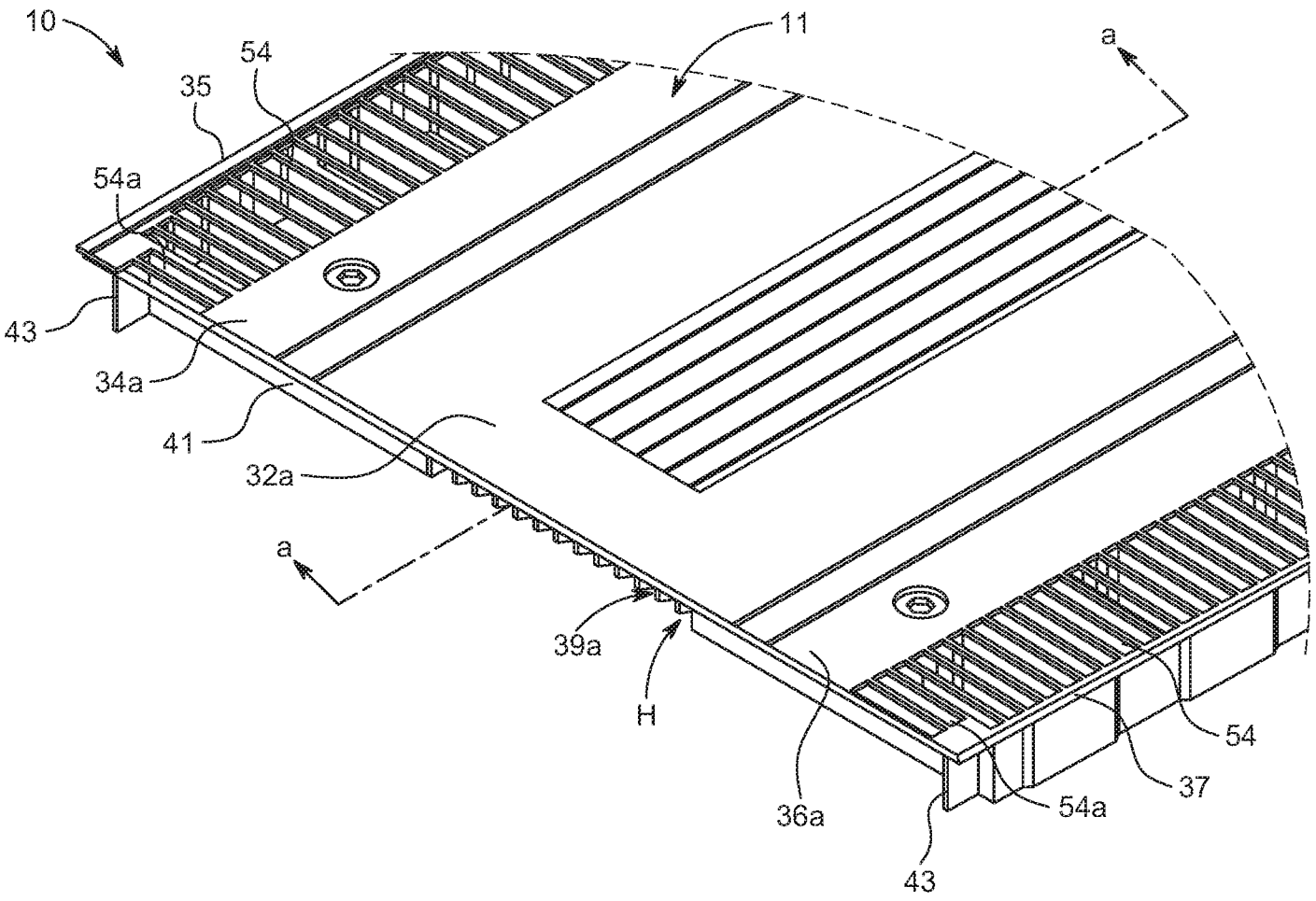
FIG. 3 is a partial perspective view of a front edge of the ridge vent of FIG. 1 in accordance with embodiments of this invention.

Referring now to FIG. 3, an exemplary front edge 39*a* is depicted. The front edge 39*a* of the ridge vent 10 has a front face 41 extending between and perpendicular to the left and right edges, 35 and 37, and two front face projections 43 disposed on the front face 41 and inset from the left and right edges, 35 and 37, respectively. The front face projections 43 are evenly spaced apart on the front face 41 and extend longitudinally and perpendicularly away from the front face 41. When the ridge vent 10 is installed on a roof, the roof planes, 16 and 18, front face 41, front face projections 43, and portions of the top surfaces, 32*a*, 34*a*, and 36*a*, which extend past the front face 41, define a rear projection receiving area H for operably receiving a portion of an adjoining ridge vent 10. The rear projection receiving area H is generally rectangular and, as will be explained below, sized and shaped to receive a rear projection or a portion of a rear projection of an adjacent ridge vent 10. The extended portions of the top surfaces, 34*a* and 36*a*, of the left and right portions, 34 and 36, which cover the front face projections 43 have vents or louvers 54*a* at the lateral portions for venting air and do not laterally extend to or past the front face projections 43. In the illustrated embodiment, the front face projections 43 are planar rectangular projections. However, it will be appreciated that the front face projections 43 could be any size or shape known in the art capable of defining a rear projection receiving area H when the ridge vent 10 is installed on a roof. In another exemplary embodiment, the front face projections 43 are omitted.

In the illustrated embodiment, the front face projections 43 extend from 0.25 to 1.00 inches, such as from 0.3 to 0.6 inches, such as about 0.4 inches from the front face 41. are 0.015 to 0.093, such as 0.031 to 0.062, such as about 0.047 inches wide, are 10 to 12 inches apart, such as about 11 inches apart, and are 0.125 to 0.625, such as 0.250 to 0.500, such as about 0.37 inches from the left and right edges, 35 and 37, respectively and a height of about 0.500 to 1.500, such as 0.625 to 1.250, such as about 0.75 inches. The top surfaces, 32*a*, 34*a*, and 36*a*, extend outwardly to cover the front face projections 43. However, it will be appreciated that the sizes and distances may vary.

Figure 4:
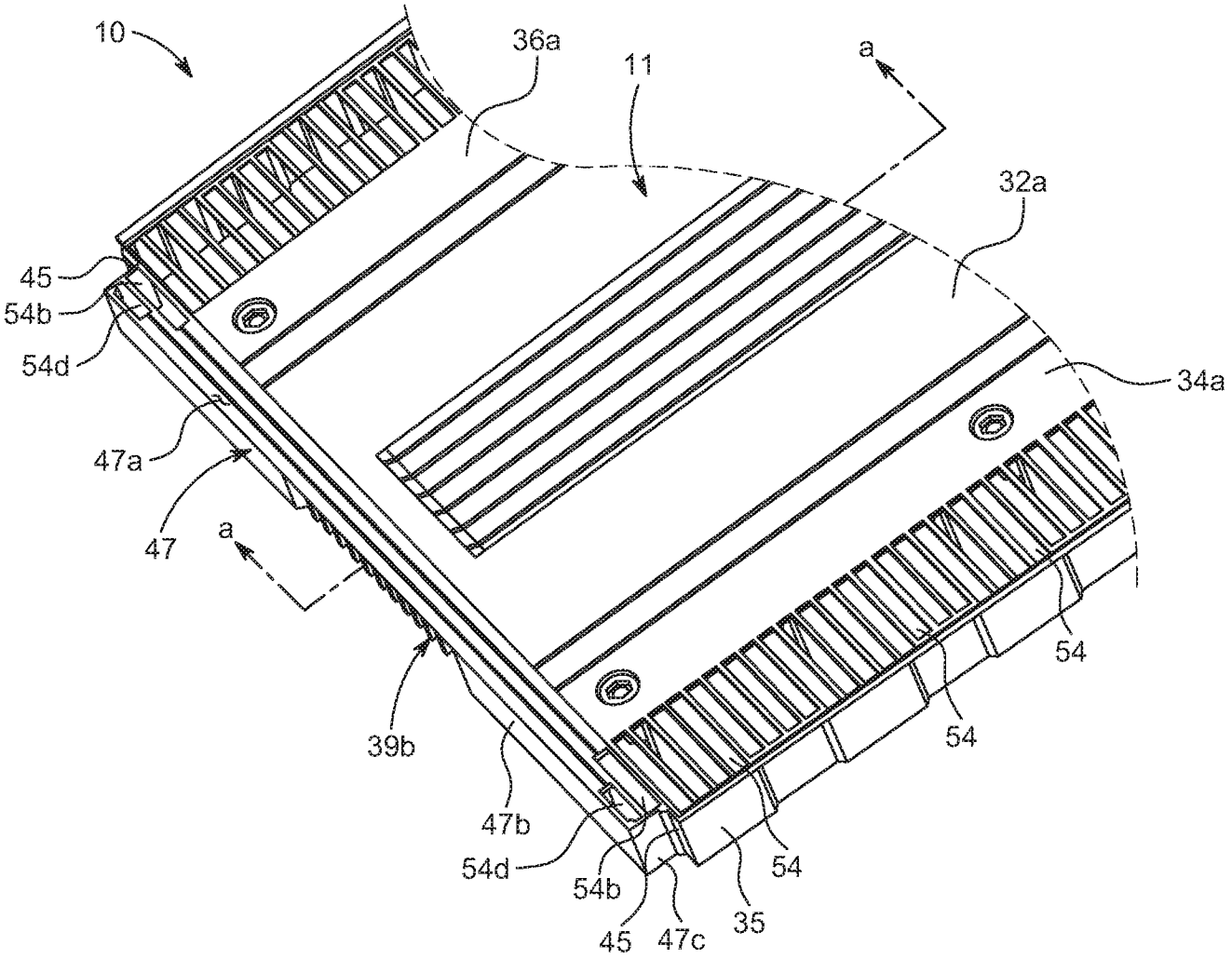
FIG. 4 is a partial perspective view of a rear edge of the ridge vent of FIG. 1 in accordance with embodiments of this invention.

Turning to FIG. 4, an exemplary rear edge 39*b* is depicted. The rear edge 39*b* of the ridge vent 10 includes a rear face 45 extending perpendicularly between the left and right edges, 35 and 37, and a rear projection 47 extending outwardly from the rear face 45. The rear projection 47 has a top surface 47*a*, a rear projection face 47*b*, left and right edges, 47*c* and 47*d*, and a bottom surface 47*e* (not pictured). The left and right edges, 47*c* and 47*d*, of the rear projection 47 are inset from the left and right edges, 35 and 37, of the ridge vent 10. In an exemplary embodiment, the rear face 45 does not extend entirely between the left and right edges, 35 and 37, and has two rear face portions, 45*a* and 45*b* (See FIG. 5), which extend between the left edge 35 of the ridge vent 10 and the left edge 47*c* of the rear projection 47 and between the right edge 37 of the ridge vent 10 and the right edge 47*d* of the rear projection 47, respectively. The top surface 47*a* of the rear projection 47 is lower than the top surfaces, 32*a*, 34*a*, and 36*a*, of the central, left, and right portions, 32, 34, and 36. The illustrated top surface 47*a* includes optional vents or louvers 54*b* at the lateral edges to permit the venting of air. In the illustrated embodiment, the louvers 54*b* are square or rectangular and the louvers 54*b* farthest from the rear face portions, 45*a* and 45*b*, are smaller in cross section than the louvers 54*b* closer to the rear face portions, 45*a* and 45*b*. However, it will be appreciated that other shapes and sizes known in the art are also contemplated which permit the flow of air to exit the ridge vent 10 at the rear projection 47 and through the louvers 54*b*. As mentioned above, the louvers 54*b* through the projection 47 are optional and can be omitted. As will be explained below in greater detail, the rear projection 47 is designed to fit within the rear projection receiving area or channel H (under the top surfaces, 32*a*, 34*a*, and 36*a*, and between the front face projections 43—See FIG. 3) of another ridge vent attached to roof planes, 14 and 16, and covering a ridge opening 12 and permit the ventilation of air from an attic to an outside environment.

Figure 7:
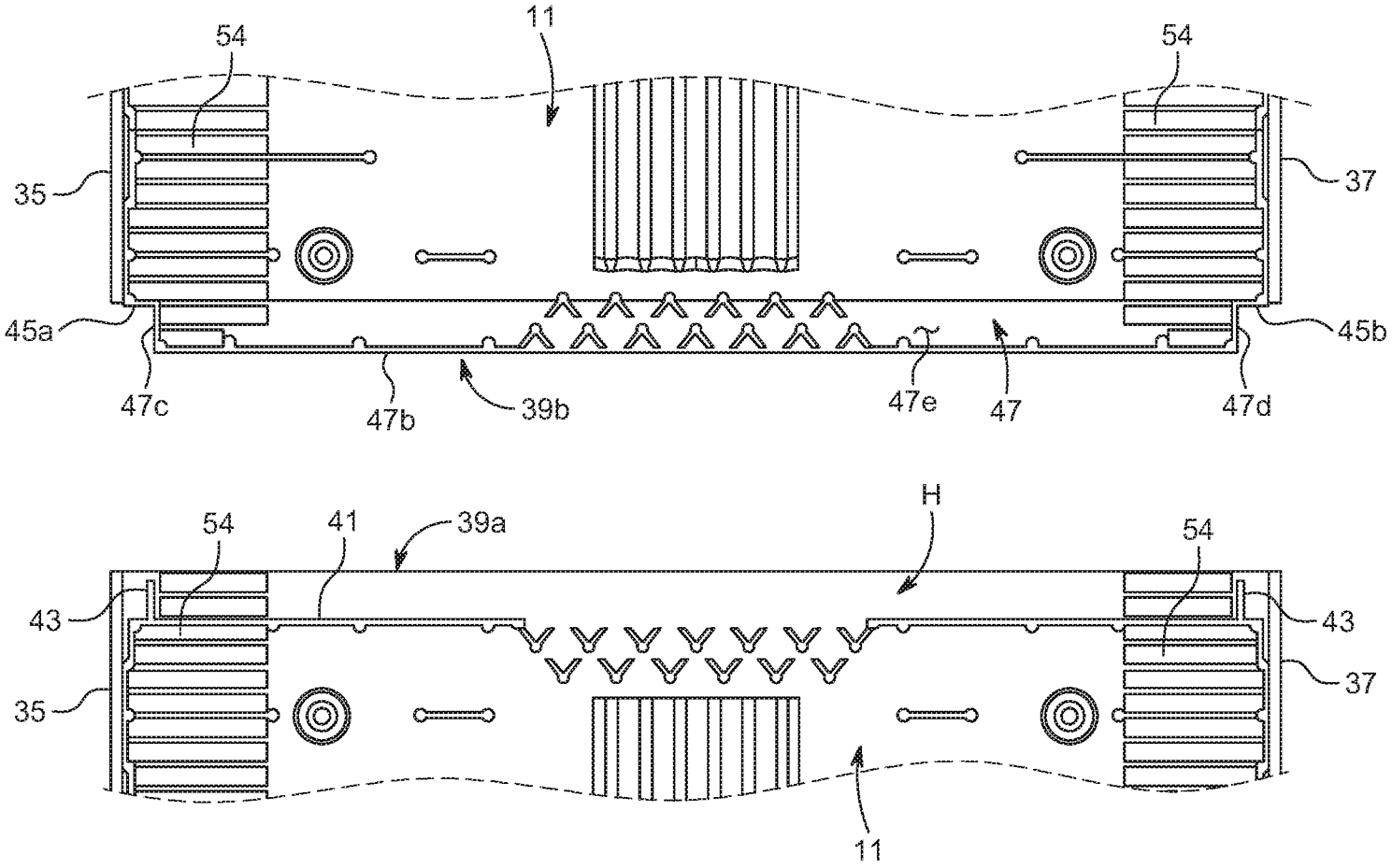
FIG. 7 is a partial bottom view of the front end of the ridge vent of FIG. 1 aligned with the rear end of a second ridge vent.
Figure 8:
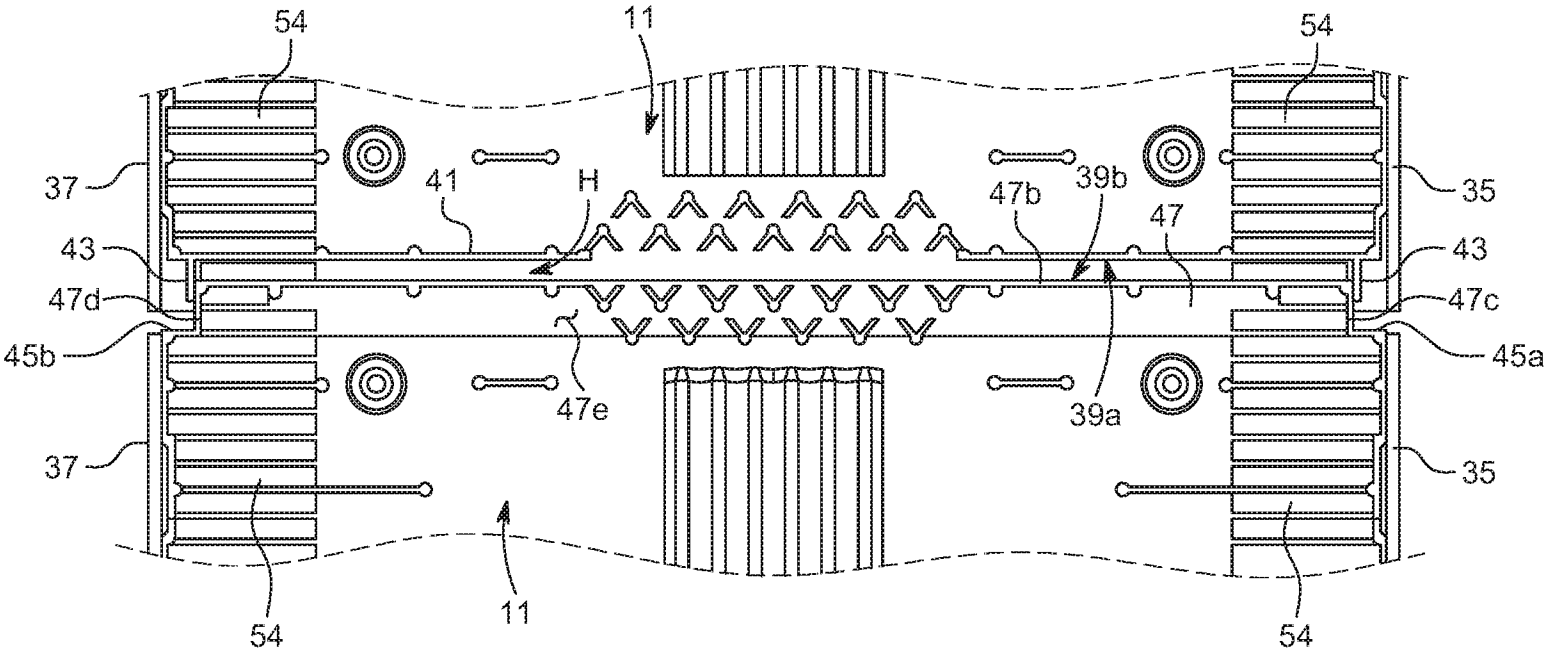
FIG. 8 is a partial bottom view of the ridge vent of FIG. 1 connected to a second ridge vent.
Figure 9:
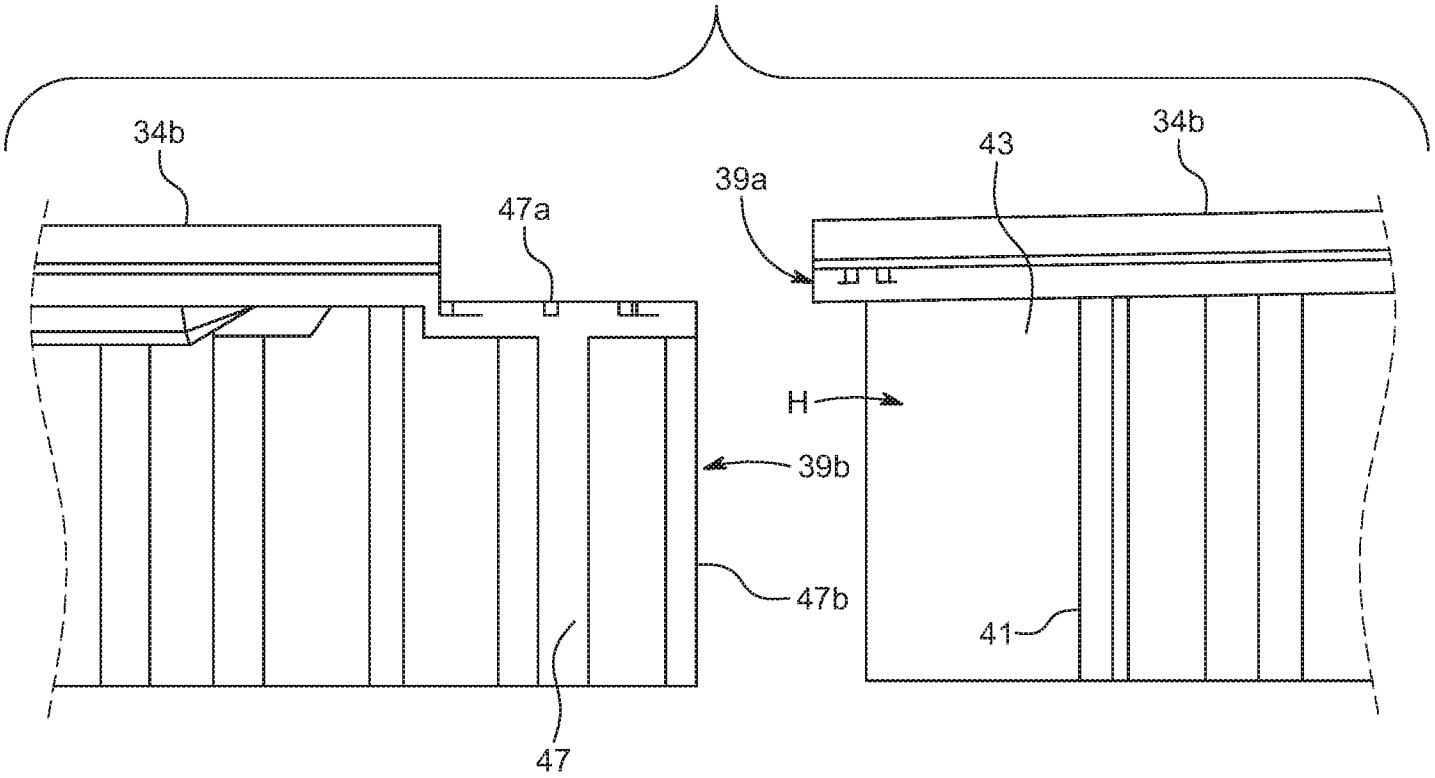
FIGS. 9 and 10 are partial cross-sectional views taken respectfully along lines a-a in FIGS. 3 and 4 of the ridge vent of FIG. 1 mated with a second ridge vent.
Figure 10:
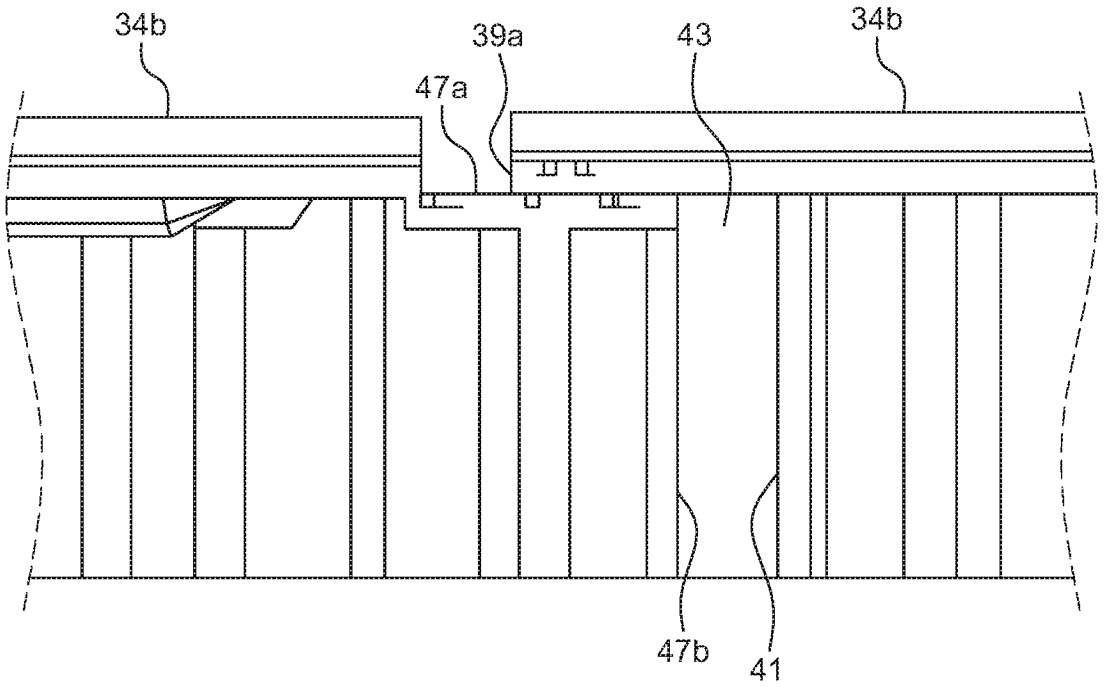

Referring to FIGS. 7, 9 and 10, in an exemplary embodiment the rear projection 47 is sized to fit snugly within the rear projection receiving area H of an adjacent ridge vent. For example, the width of the rear projection 47 between left and right edges, 47*c* and 47*d*, may be substantially equivalent to or slightly less than the distance between the inside faces of the front face projections 43 defining the sides of the rear projection receiving area H (See FIG. 7). The height of the rear projection face 47*b* may be substantially equivalent to or slightly less than the distance between the underside of the top surfaces, 32*a*, 34*a*, and 36*a* (See FIGS. 9 and 10). The bottom of the front face 41, and the rear projection 47 may extend to a distance substantially equivalent to or slightly less than the distance between the front face 41 and the lateral edge of the top surfaces, 32*a*, 34*a*, and 36*a* (See FIGS. 9 and 10). As such, when the rear projection 47 of one vent is fully inserted into the rear projection receiving area H of a second vent, the left and right edges, 47*c* and 47*d*, of the rear projection 47 may contact the inside faces of the front face projections 43 defining the sides of the rear projection receiving area H, the rear projection face 47*b* may contact the front face 41, and the top surface 47*a* of the rear projection 47 may contact the underside of the top surfaces, 32*a*, 34*a*, and 36*a*, defining the rear projection receiving area H. In the illustrated embodiment, the rear projection extends outward from 0.25 to 1.00 inches, such as from 0.3 to 0.6 inches, such as about 0.4 inches from the front face 45, are 10 to 12 inches wide, such as about 11 inches, are inset 0.125 to 0.625, such as 0.250 to 0.500, such as about 0.37 inches from the left and right edges, 35 and 37, respectively and have a height of about 0.500 to 1.500, such as 0.625 to 1.250, such as about 0.75 inches. However, it will be understood that the rear projection 47 may have any width, height, or depth that is less than the width, height, or depth of the rear projection receiving area H such that the rear projection 47 of one vent may be inserted into the rear projection receiving area H of an adjacent vent.

As described above, the left and right edges, 47*c* and 47*d*, of the rear projection 47 are inset from the left and right edges, 35 and 37, of the ridge vent 10 and sized to be received within the rear projection receiving area or channel H of an adjoining ridge vent 10. In the illustrated embodiment, the left and right edges, 47*c* and 47*d*, of the rear projection 47 are inset from the left and right edges, 35 and 37, of the ridge vent 10. Optionally, as will be described below in greater detail, the left and right edges, 47*c* and 47*d*, of the rear projection 47 are sized and shaped to operatively telescope with the front projections 43 when the rear projection 47 of one ridge vent 10 is inserted into the rear projection receiving area H of an adjoining ridge vent 10.

Figure 5:
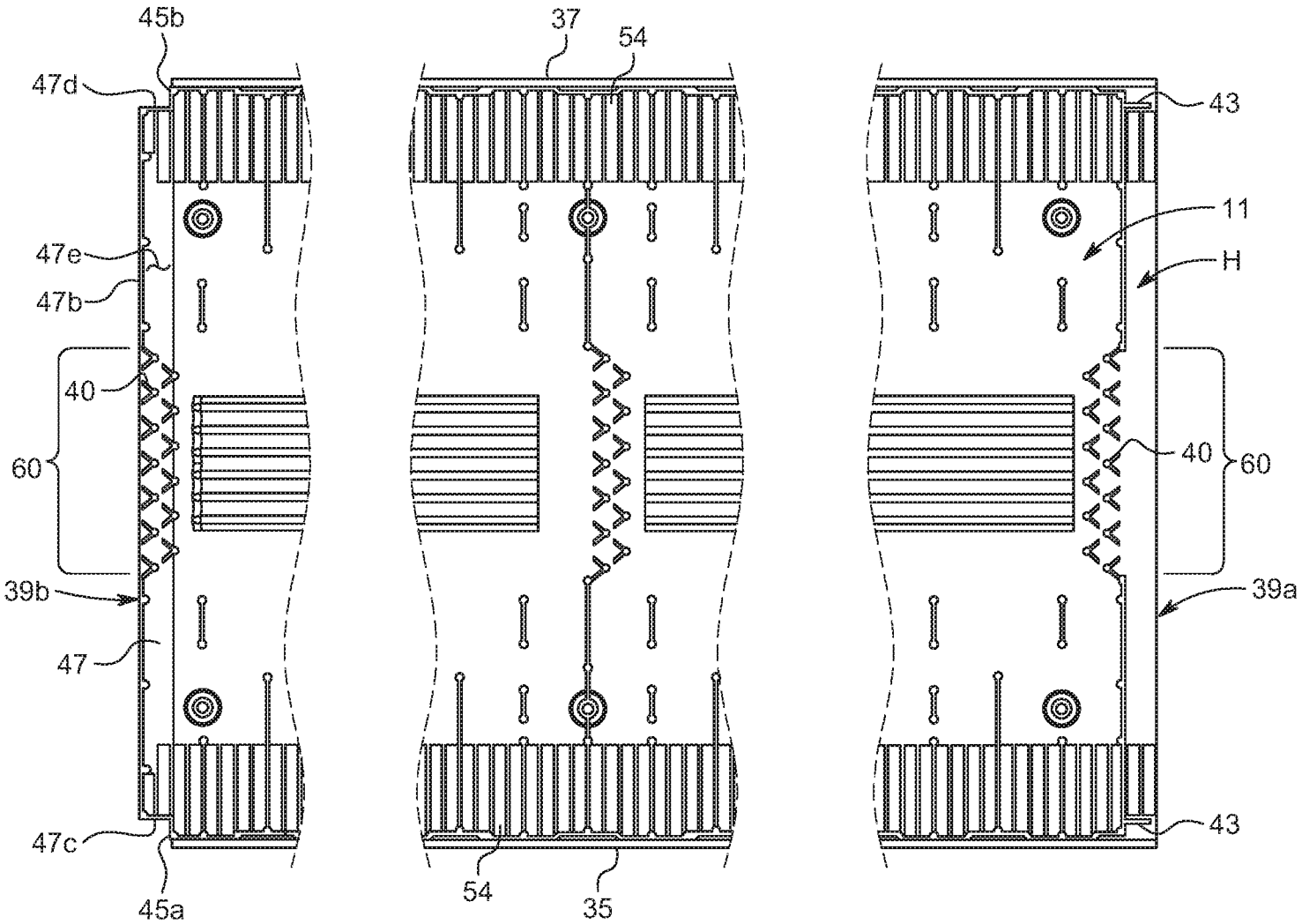
FIG. 5 is a partial elevational view of the bottom of the ridge vent of FIG. 1.

Referring now to FIG. 5, the underside of an exemplary ridge vent 10 is shown. Apart from the front projections 43 and rear projection 47, the underside of the vent 10 can optionally be substantially similar to that of the vent described in U.S. patent application Ser. No. 12/393,261 to Grubka et al., filed Feb. 10, 2009, and published May 6, 2010 as U.S. Published Patent Application Publication No. 2010/0112932A1, which is incorporated herein by reference in its entirety. U.S. Published Patent Application Publication No. 2010/0112932A1 is referred to herein as "the Grubka application." It will be appreciated that other shapes, geometries, features, and designs for the underside of the ridge vent can be used.

In the illustrated embodiment, the center portion 32 includes a plurality of projections 40 extending from the top surface 32*a* of the center portion 32. The plurality of projections 40 are configured to nest against each other as the center portion 32 of the ridge vent 10 is flexed, thereby effectively sealing the end of the center portion of the ridge vent 10. In an exemplary embodiment, the plurality of projections 40 each have a plurality of legs that have a cross-sectional shape in the form of a "V." The plurality of projections 40 are configured in two staggered rows. As the ridge vent 10 is flexed, the plurality of projections 40 form a sealed portion 60 at least at the front end of the ridge vent 10. Exemplary projections 40 are described in detail in the Grubka application.

In the illustrated embodiment, the rear projection 47 also has a plurality of projections 40 extending downward from the bottom surface 47*e* of the rear projection 47 at and inset from the rear projection face 47*b*. As discussed above, the plurality of projections 40 are configured to nest against each other as the rear projection 47 is flexed with the remainder of the ridge vent 10, thereby forming a sealing structure for the end of the rear projection 47 of the ridge vent 10.

Figure 6:
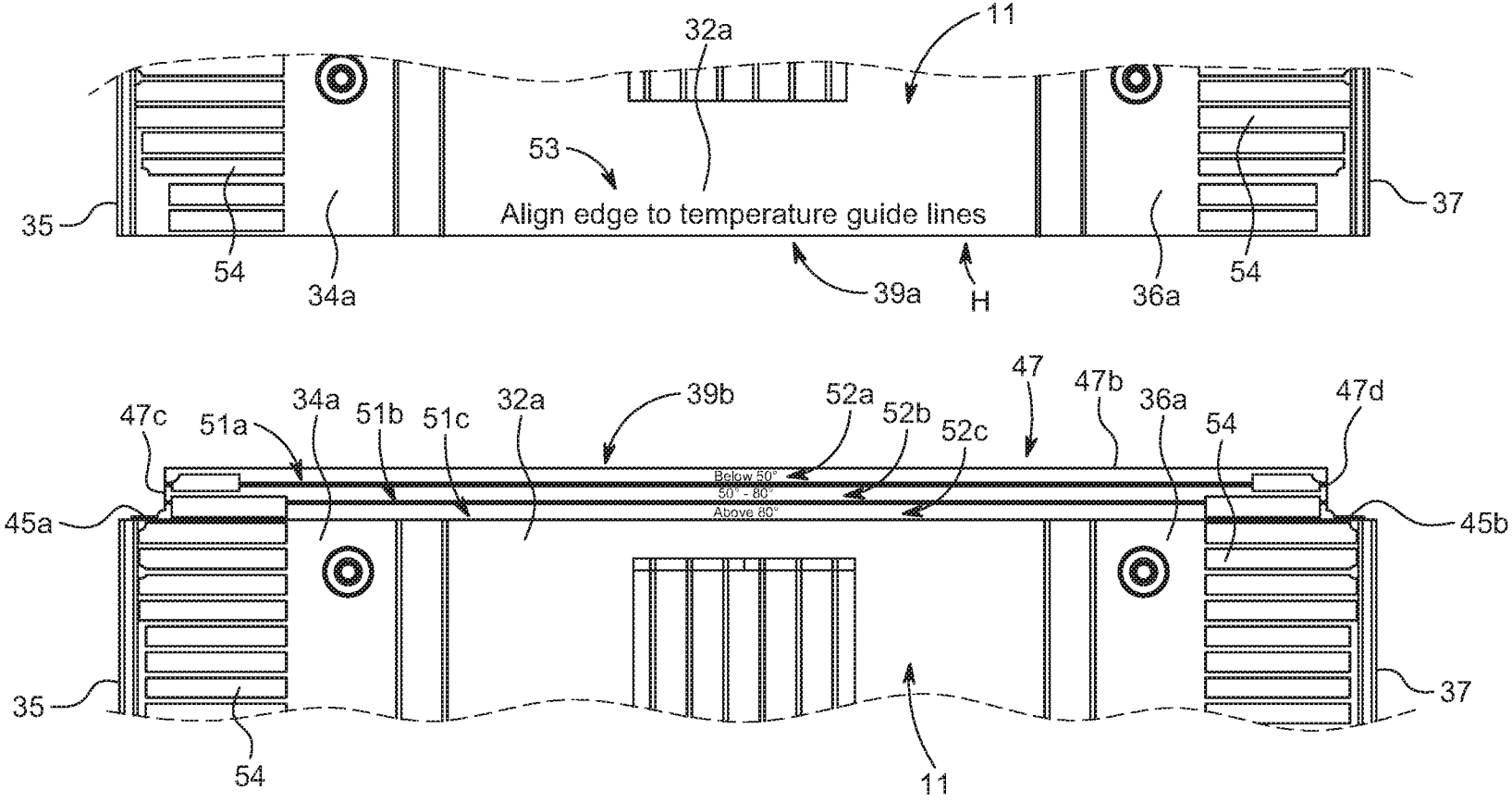
FIG. 6 is a partial top view of the front end of the ridge vent of FIG. 1 aligned with the rear end of a second ridge vent.

Turning to FIG. 6, the ridge vent 10 may optionally include installation temperature guide lines, 51*a*, 51*b*, and 51*c*, disposed laterally on the top surface 47*a* of the rear projection 47 and first indicia, 52*a*, 52*b*, and 52*c* disposed near (either above or below) the temperature guide lines, 51*a*, 51*b*, and 51*c*. FIG. 6 illustrates an embodiment with three installation temperature guide lines. However, the ridge vent 10 may include any number of temperature guide lines. In the example illustrated by FIG. 6, the vent includes two non-functional temperature guidelines (e.g. 51*a*, 51*b*) and a functional guide line 51*c*. The non-functional guide lines merely provide a visual indicator of where one vent should be installed relative to another vent. The functional guide line provides a stop or other tactile aid for positioning one vent with respect to another. In the example illustrated by FIG. 6, the functional guideline 51*c* is an edge of the vent, above the projection 47. The ridge vent 10 can have any number of functional and non-functional guide lines. The ridge vent 10 may also include second indicia 53 at the lateral edge of the top surface, 32*a*, 34*a*, and 36*a*, above the rear projection receiving area H. The temperature guide lines, 51*a*, 51*b*, and 51*c*, extend laterally across the top surface 47*a* of the rear projection 47 between the left and right ends, 47*c* and 47*d*. As will be explained below, the temperature guide lines, 51*a*, 51*b*, and 51*c*, each correspond to a distance which the rear projection 47 should be inserted into the rear projection receiving area H depending on the ambient temperature at the time of installation of the ridge vent 10. The first indicia, 52*a*, 52*b*, and 52*c* disposed near the temperature guide lines, 51*a*, 51*b*, and 51*c*, would indicate to a user which temperature guide line, 51*a*, 51*b*, and 51*c*, to use during installation. For example, the first indicia, 52*a*, 52*b*, and 52*c* may indicate the temperature range corresponding to each temperature guide line, 51*a*, 51*b*, and 51*c*. Further, the second indicia 53 at the lateral edge of the top surfaces, 32*a*, 34*a*, and 36*a*, above the rear projection receiving area H may include instructions for a user to easily follow during installation of the ridge vents, such as "Align edge to temperature guide lines." However, configuring the ridge vent 10 to include first and second indicia, 52*a*, 52*b*, 52*c*, and 53, is optional and not necessary for the use of the ridge vent 10.

In use, the temperature guide lines, 51*a*, 51*b*, and 51*c*, facilitate the proper installation of ridge vents 10 by a user at various temperatures. Depending upon the ambient temperature at installation, the ridge vents 10 may either expand or contract after installation as the temperature changes. As the rear projection 47 of one ridge vent 10 is received laterally in the rear projection receiving area H when ridge vents are overlapped, the rear projection 47 of the first vent will either extend further into or retract somewhat from the rear projection receiving area H, due to expansion or contraction of the ridge vent 10 when the weather changes after installation. If the ridge vents 10 are installed at a cold temperature, they will expand later when it heats up, and if they're installed at a hot temperature, they will contract later when the temperature drops. As will be explained below, the temperature guide lines, 51*a*, 51*b*, and 51*c*, allow a user to easily identify, based on the ambient temperature, how far to insert the rear projection 47 of one ridge vent into the rear projection receiving area H of an adjacent vent such that the installed ridge vent system may telescope and maintain proper engagement regardless of temperature changes.

In the illustrated embodiment, the temperature guide lines, 51*a*, 51*b*, and 51*c*, are 0.05 to 0.50 inches apart, such as 0.1 to 0.250 inches apart, such as about 0.175 inches apart. However, any spacing can be selected based on the material that the vent is made from and the size of the vent. Further, the first indicia, 52*a*, 52*b*, and 52*c*, indicate that the temperature guidelines, 51*a*, 51*b*, and 51*c*, correspond to three temperature zones for installation: below 50°, between 50° and 80°, and above 80°. However, it will be understood that more or fewer temperature guide lines could be used and the temperature ranges for each temperature guide line could differ depending on the material of the ridge vent, the temperature range for the climate of installation, or any other factor known in the art.

Turning to FIGS. 7-10, the telescoping coupling of two adjacent ridge vents 10 is shown. First, two ridge vents 10 are laterally aligned and spaced apart (FIGS. 7 and 9) such that the right and left edges, 35 and 37, of each vent are parallel and the front face projections 43 of one vent 10 are facing the rear projection 47 of the other vent. The two vents 10 are then laterally brought together such that the rear projection 47 of one vent is received within the rear projection receiving area or channel H of the second vent 10. The rear projection 47 is slid between front face projections 43 (FIG. 8) and the top surface 47*a* of the rear projection 47 is moved under the portions of the top surfaces, 32*a*, 34*a*, and 36*a*, defining the rear face receiving area H (FIG. 10). The inside portions of the front face projections 43 may receivingly engage the left and right edges, 47*c* and 47*d*, of the rear projection 47. Optionally, an exemplary ridge vent 10 may be designed such that there is interlocking engagement between the right and left edges, 47*c* and 47*d*, of the rear projection 47 of the first vent and the front face projections 43 and/or between the top surface 47*a* of the rear projection 47 and the underside of the portions of the top surfaces, 32*a*, 34*a*, and 36*a*, defining the rear projection receiving area H.

Once the rear projection 47 of the second ridge vent 10 is received in the rear projection receiving area H of the first ridge vent 10, one or both ridge vents 10 may be fastened to the roof above the ridge opening 12. In such an installation, air may pass from the attic, through the louvers 54*b* in the top face 47*a* of the rear projection 47, through the louvers 54*a* in the top face, 34*a* and 34*b*, defining the rear projection receiving area H, and to the outside environment. Additionally, where the ridge vents do not overlap, air may pass from the attic, through the louvers 54 in the top surfaces, 34*a* and 34*b*, of the left and right portions, 34 and 36

At installation, a user will insert install a first ridge vent 10 over the ridge opening 12 on a roof with the rear projection receiving portion H oriented toward the remaining exposed portion of the ridge opening 12. The user will flex the first ridge vent 10 to form a ridge vent angle β, wherein the ridge vent angle β is configured to correspond with a slope between roof decks or planes, 14 and 16, defining the ridge opening 12. The user will then place a second ridge vent 10 over the ridge opening 12 and adjacent to the first ridge vent 10 with the rear projection 47 oriented toward the rear projection receiving portion H of the first ridge vent 10. The user will then slide the rear projection 47 between the forward projections 43 of the first ridge vent 10. The user will then insert the rear projection 47 into the rear projection receiving area H until the lateral edge of the top surface, 32*a*, 34*a*, and 36*a*, of the first ridge vent 10 is aligned with the temperature guide line, 51*a*, 51*b*, or 51*c*, of the second ridge vent 10 which corresponds to the ambient temperature at installation. The user will then faster or otherwise secure the second ridge vent 10 to the roof. The user will repeat the process until the entirety of the ridge opening 12 is covered.

While the method of installation has been described as installing a first ridge vent 10, placing the rear projection 47 of a second ridge vent 10 into the rear projection receiving area H of the first ridge vent 10, and fastening the second ridge vent 10, the process may be reversed. For example, the vents may be installed facing the other direction such that the first ridge vent is installed with the rear projection 47 extending toward the remaining uncovered portion of the ridge opening 12 and the second ridge vent 10 may be placed over the first ridge vent 10 such that the rear projection receiving portion H of the second ridge vent 10 may be slipped over the rear projection 47 of the first ridge vent 10.

The principles and mode of operation of the roof ridge vent have been described in its preferred embodiments. However, it should be noted that the roof ridge vent may be practiced otherwise than as specifically illustrated and described without departing from its scope.

What is claimed is:

1. A ridge vent configured to cover an open ridge of a roof and allow a flow of air to exit from the open ridge through the ridge vent, the ridge vent comprising:

a ridge vent body;

a projection extending from the ridge vent body; and a projection receiving portion extending into the ridge vent body;

wherein the ridge vent is configured such that when a first ridge vent is secured over a ridge opening the projection of a second ridge vent is at least partially receivable in a projection receiving portion of the first ridge vent, and wherein the projection comprises a plurality of temperature guide lines disposed on a top surface of the projection which indicate a distance the projection should be inserted into the projection receiving portion of another ridge vent.

2. The ridge vent of claim 1 wherein the projection receiving portion comprises a top wall of the ridge vent body and first and second projections downwardly from the top wall and inset from left and right edges of the ridge vent body.

3. The ridge vent of claim 1 wherein the projection includes a top wall and first and second walls extending downward from the top wall.

4. The ridge vent of claim 1 wherein the projection comprises a plurality of temperature indicia disposed on a top surface of the projection which indicate a distance the projection should be inserted into the projection receiving area of another ridge vent for a corresponding plurality of ambient installation temperature ranges.

5. The ridge vent of claim 1 wherein the ridge vent has a plurality of louvers positioned in a left portion and a right portion.

6. The ridge vent of claim 1 wherein the ridge vent has a plurality of louvers positioned in the projection.

7. The ridge vent of claim 1 further comprising a center portion having opposing ends, at least one of the opposing ends having a plurality of projections, the plurality of projections each having a plurality of legs that have a cross-sectional shape in the form of a "V", wherein the plurality of legs form sealing structures.

8. A ridge vent system comprising:

first and second ridge vent sections each comprising:

a ridge vent body;

a projection extending from the ridge vent body; and a projection receiving portion extending into the ridge vent body;

wherein the projection of the second ridge vent section is at least partially disposed in the projection receiving portion of the first ridge vent section, and wherein the projection comprises a plurality of temperature guide lines disposed on a top surface of the projection which indicate a distance the projection should be inserted into the projection receiving portion of another ridge vent.

9. The ridge vent system of claim 8 wherein the projection receiving portions of the first and second ridge vent sections comprise a top wall of the ridge vent body and first and second projections downwardly from the top wall and inset from left and right edges of the ridge vent body.

10. The ridge vent system of claim 8 wherein the projection includes a top wall and first and second walls extending downward from the top wall.

11. The ridge vent system of claim 8 wherein the projection comprises a plurality of temperature indicia disposed on a top surface of the projection which indicate a distance the projection should be inserted into the projection receiving area of another ridge vent for a corresponding plurality of ambient installation temperature ranges.

12. The ridge vent system of claim 8 wherein each ridge vent has a plurality of louvers positioned in the left and right portions.

13. The ridge vent system of claim 8 wherein the center portion of the ridge vents have opposing ends, at least one of the opposing ends having a plurality of projections, the plurality of projections each having a plurality of legs that have a cross-sectional shape in the form of a "V", wherein the plurality of legs form sealing structures.

14. The ridge vent system of claim 8 wherein the front edge of each ridge vent interlocks with the rear edge of a subsequently installed ridge vent.

15. A method for installing ridge vents comprising:

positioning a first ridge vent over the open ridge of the roof;

fastening the first ridge vent to the roof deck;

positioning a front face projection of a second ridge vent in a same direction as the first ridge vent;

inserting the front face projection of the second ridge vent in a projection receiving area of the first ridge vent, wherein a depth of said inserting is selected based on an ambient installation temperature; and covering the installed ridge vents with ridge shingles, wherein the first ridge vent includes a plurality of temperature guide lines disposed on the projection which indicate a distance the projection should be inserted into the projection receiving area of another ridge vent.

* * * * *